FOLDING PLATFORM ROCKER

DISCLOSURE STATEMENT

The following U.S. Patents were provided applicant by a professional searcher making a preliminary patentability search on this application in the Patent files of the U.S. Patent and Trademark Office.

U.S. Pat. No. 147,589, Baer;
U.S. Pat. No. 488,704, Thornbeck;
U.S. Pat. No. 1,672,437, Vance;
U.S. Pat. No. 1,711,371, Zentmyer;
U.S. Pat. No. 1,724,220, Puccia;
U.S. Pat. No. 3,671,072, Holt;
U.S. Pat. No. 4,025,107, Chippa.

U.S. Pat. No. 488,704 (Thornbeck) discloses a folding rocking chair having a ground frame composed of two bars N, rockers G connected to the ground frame and legs B and D connected to the rockers. U.S. Pat. No. 4,025,107 (Chippa) discloses a collapsible spoon-bottom chair having a scissor-type lever 16, each individual lever 16 having opposite ends 18 and 20, the ends being slidable in guide rails 14.

BACKGROUND OF THE INVENTION

The invention relates to a portable, collapsible rocking chair.

Rocking chairs and folding chairs are well known. The rocking chairs can take various types from one just having a rocker at the lower end of front and back legs on each side or it can be rockers mounted on a base which is known as a platform rocker. Folding chairs are also widely known. There are many varities of them. Perhaps the most common are the lawn chairs which have different folding features, but all can collapse from the upright position for sitting to a folded position for storage.

SUMMARY OF THE INVENTION

This is a foldable, portable, full size platform rocker which has two parallel rocker bases and two rockers mounted thereon by heavy duty springs which permits the rocking action between the rocker and the rocker base. A support rod extends between the two rockers in the front of the chair. There is a seat frame supported by two front legs and two rear legs each supported from the two parallel rockers. The seat frame is attached to the two front legs by pivots intermediate the top and bottom of the legs and are connected to the rear legs at a point below the top portion. The top portion of the rear legs are each curved toward the front legs. Each of the side frames of the back of the chair is pivotally connected to the top of each of the rear legs. Each of the rear legs are connected by pivots to the back end of the rocker.

There is a support bar going across the front between the two rockers. The lower end of the two front legs have slots which fit over the support rod. The side back frames of the back of the chair each has a longitudinal slot. There is an arm on each side of the chair connecting the top of the front leg to a bolt which extends through the slot in the back side frame. The front of the arm is pivotally connected to the top of the front leg. A side guide is pivotally mounted at its rear end to the pivot between the top of the rear leg and the side frame of the back. The front end of the side guide is pivotally connected to the front leg below the pivot for the seat frame. The back frame and the seat frame can be covered with wooden slats or fabrics as desired. By manipulating the back and the seat, i.e., pulling together or pushing apart the chair can be extended to a sitting position or retracted to its collapsed position.

It is therefore an object of this invention to provide a portable platform rocking chair.

DETAILED DESCRIPTION OF THE INVENTION

Figure 1:
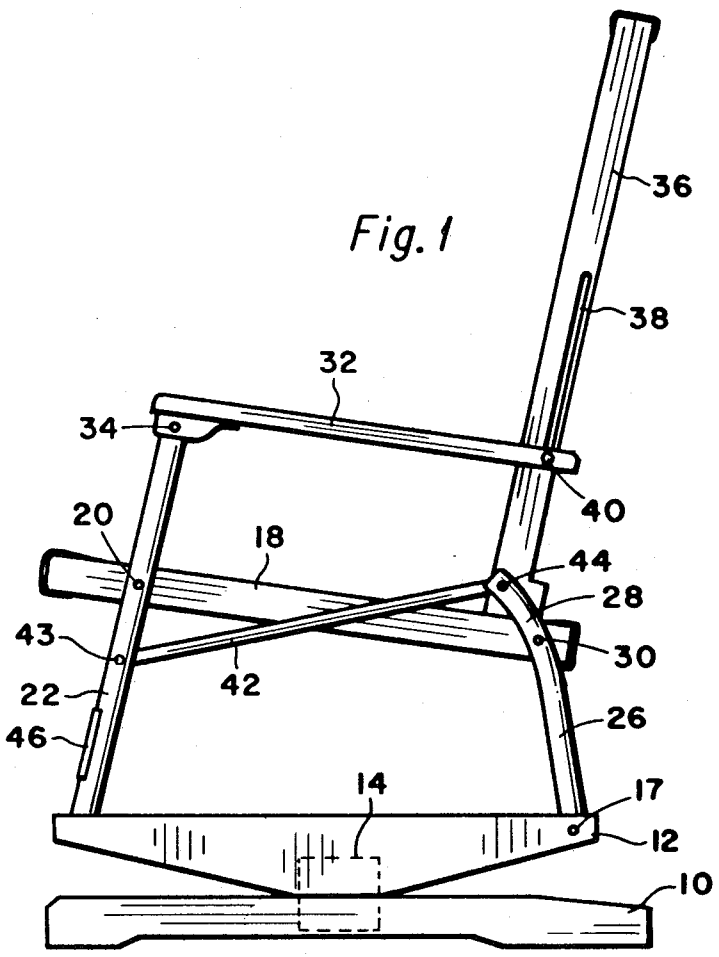
FIG. 1 shows a side view of the portable platform rocker of my invention.
Figure 2:
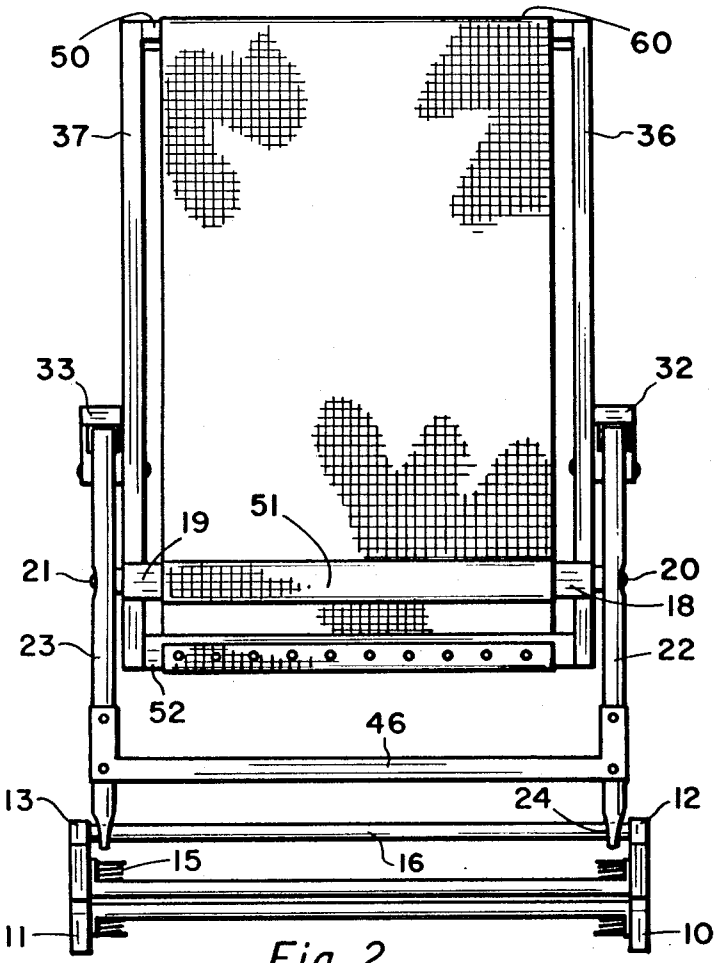
FIG. 2 illustrates a front view of my portable, foldable platform rocker.
Figure 4:
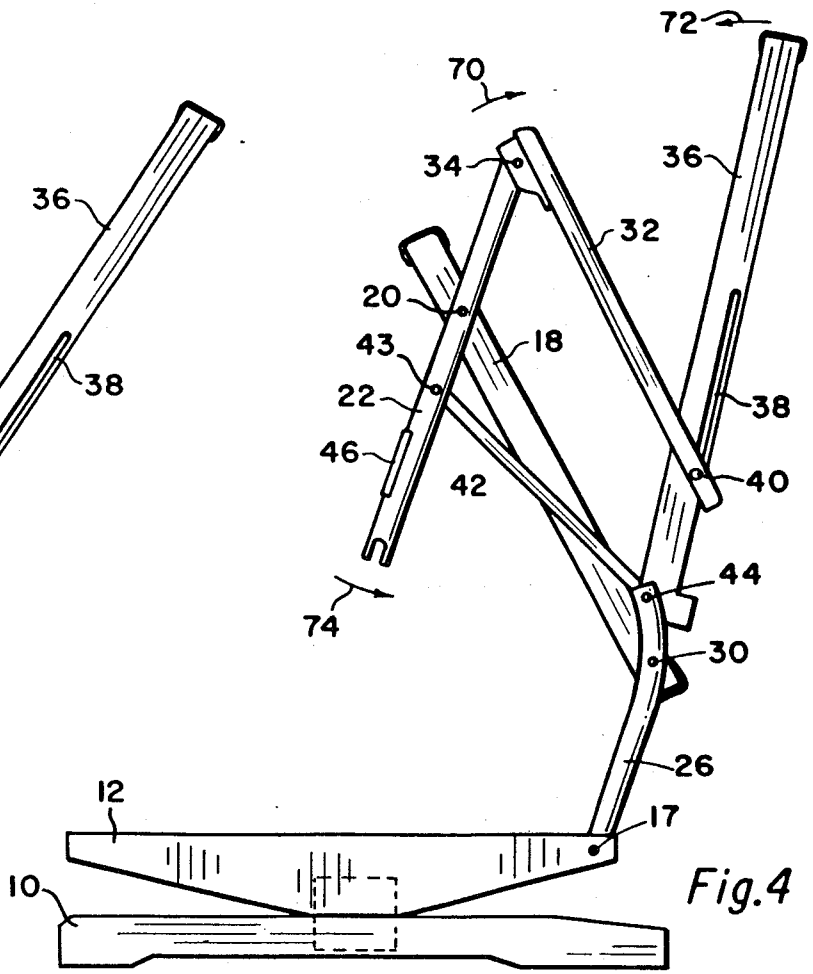
FIGS. 3, 4, 5, 6 and 7 show progressive steps of collapsing the foldable platform rocker of FIG. 1.
Figure 3:
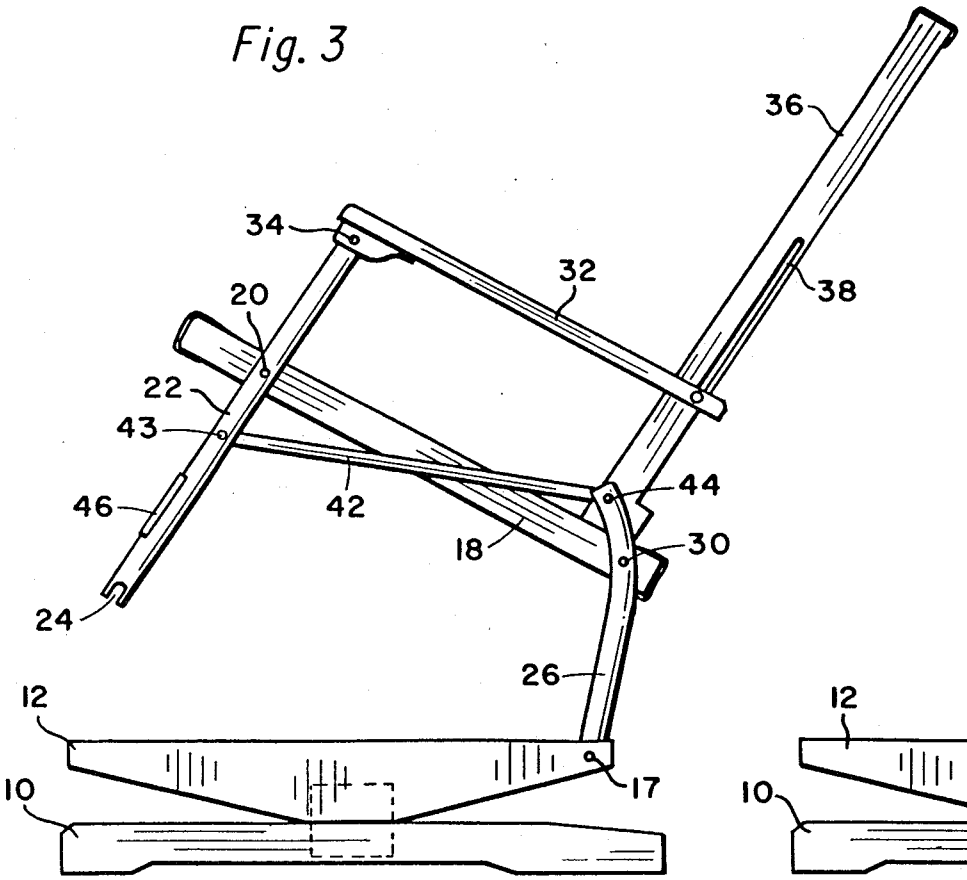
Figure 5:
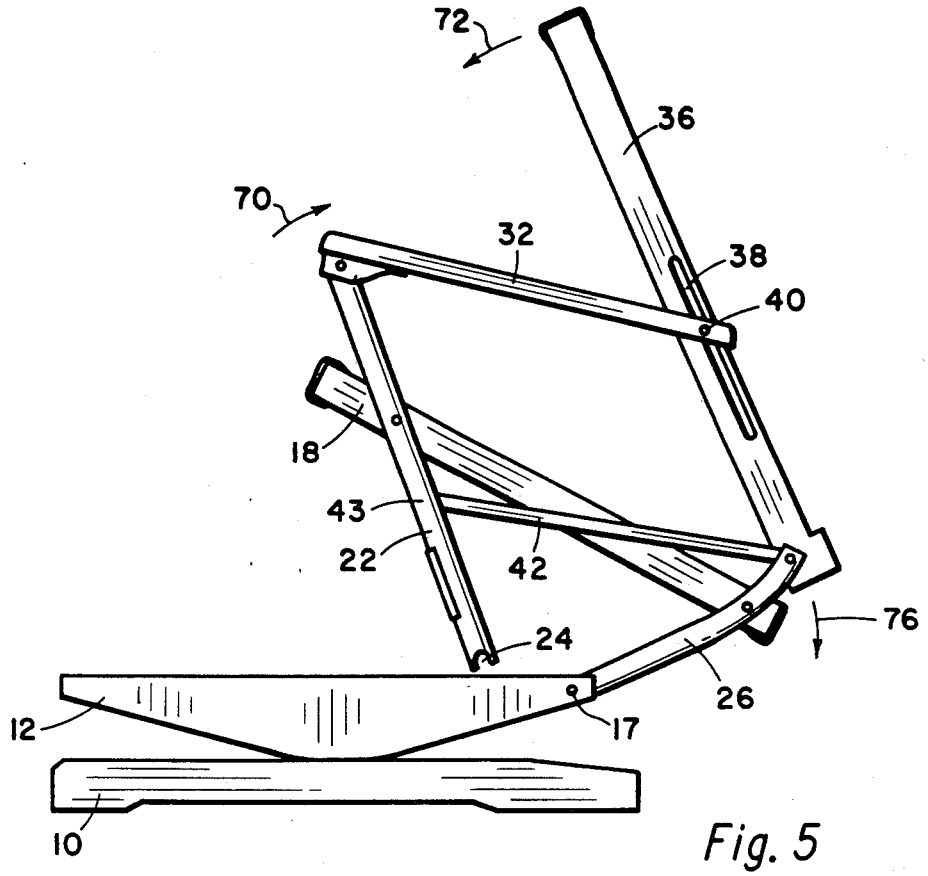
Figure 6:
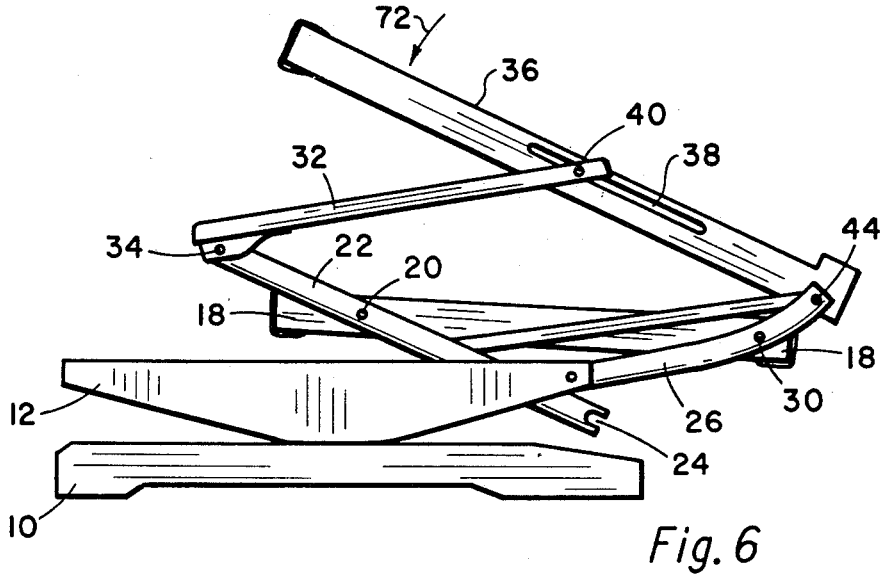
Figure 7:
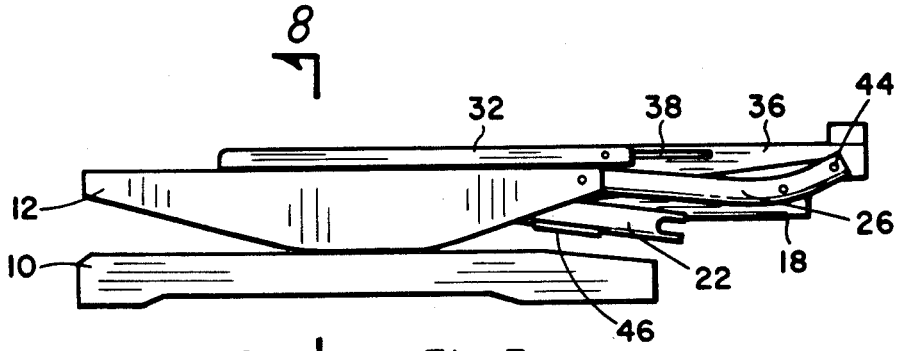
Figure 8:
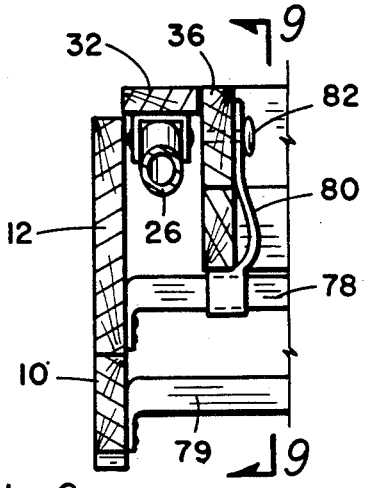
FIG. 8 is a view taken along the line 8—8 of FIG. 7 and shows the latching system for holding the chair in its folded position.
Figure 9:
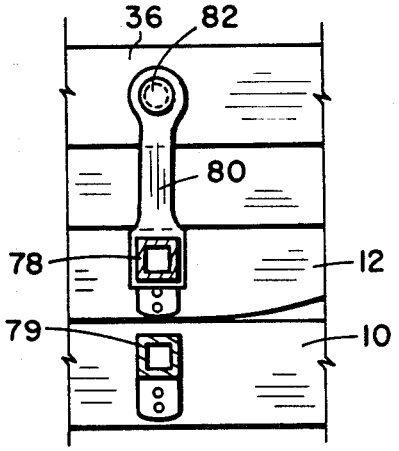
FIG. 9 is a view taken along the line 9—9 of FIG. 8.
Figure 10:
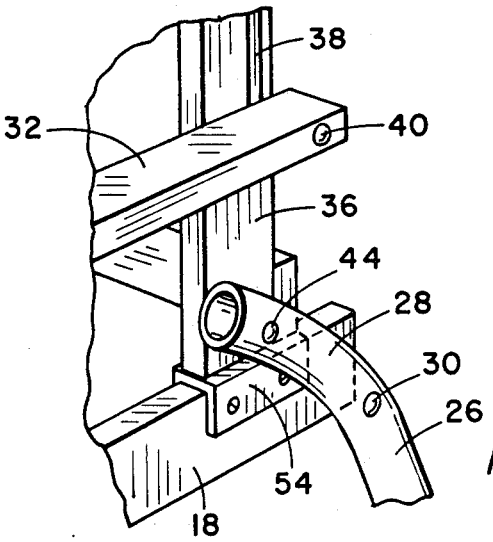
FIG. 10 is an enlarged view showing the top of the rear leg attached to the lower part of the back frame.

Attention is first directed to FIG. 1 which shows a preferred embodiment of my invention. Shown thereon is a base 10 supporting a rocker 12 through support means 14 which are typically heavy duty two coil springs which permits the rocking action between the rocker and the base while holding the two parts 10 and 12 sturdily together. As shown in FIG. 2 there is of course a second base 11, a second rocker 13 and a second support means 15 which are essentially identical to base 10, rocker 12 and support means 14. The top of the front of rockers 12 and 13 are connected by a support rod 16.

Referring back to FIG. 1 there is shown a seat side frame 18 which is supported near its front end by a pivot 20 on front leg 22. The lower end of front leg 22 is provided with a slot 24 which fits over support rod 16 when the chair is in its upright position as shown in FIGS. 1 and 2. There are a pair of rear legs 26 which have an upper curved portion 28 which curves toward the front of the chair. A pivot 30 located at about the point where the leg 26 curves connects the rear of the seat side frame 18 to the leg 26. An arm 32 is connected to the top of front leg 22 by pivot 34. A back 36 is provided having a slot 38. The back end of arm 32 is connected by a bolt 40 which extends through slot 38. The length of slot 38 is sufficient to permit the movement of the bolt 40 as depicted in drawings, FIGS. 3 through 7.

A side guide 42 is also provided. It connects at one end by pivot 44 to front leg 22 at a point below pivot 20. The other end of side guide 42 connects through pivot 44 to the top end of curve section 28 of the rear leg 26. It is to be understood that FIG. 1 shows only one side of my collapsible portable rocker. However, there is another side having corresponding parts. Some of those parts are illustrated in FIG. 2. For example, there is a corresponding back side frame 37 which corresponds to back frame 36. A second front leg 23 which corresponds to front leg 22. A front leg brace 46 connects legs 22 and 23. There is a corresponding arm 33 which corresponds to arm 32. There is also a seat pivot 21 which corresponds to seat pivot 20. The back side frames 36 and 37 are provided with a top frame 50 and a bottom frame 52. These frames support some body

United States Patent [19]

Gleckler et al.

[11] Patent Number: 4,772,068

[45] Date of Patent: Sep. 20, 1988

[54] ADJUSTABLE FISHING AND CAMPING CHAIR

[76] Inventors: Robert C. Gleckler, 2450 Pepperwood Ave., Long Beach, Calif. 90815; David W. Gleckler, 3527 Kallin Ave., Long Beach, Calif. 90808

[21] Appl. No.: 297,059

[22] Filed: Aug. 27, 1981

[51] Int. Cl.[4] ..... A47C 4/00

[52] U.S. Cl. ..... 297/39; 297/325; 248/188.5

[58] Field of Search ..... 297/39, 35, 38, 325; 248/188.5

[56] References Cited

U.S. PATENT DOCUMENTS

| | | | |
|---|---|---|---|
| 2,615,499 | 10/1952 | Wallace | 297/325 |
| 2,731,072 | 1/1956 | Post | 248/188.5 X |
| 2,871,921 | 2/1959 | Arnold | 297/39 |
| 3,094,358 | 6/1963 | Hartman | 297/39 X |
| 3,947,140 | 3/1976 | Thomas | 248/188.5 |

FOREIGN PATENT DOCUMENTS

| | | | |
|---|---|---|---|
| 548903 | 7/1956 | Belgium | 297/39 |
| 514038 | 2/1955 | Italy | 297/39 |
| 829937 | 3/1960 | United Kingdom | 297/35 |

*Primary Examiner*—Francis K. Zugel
*Attorney, Agent, or Firm*—Charles H. Thomas

[57] ABSTRACT

A camping and fishing chair is provided which includes means at the rear of the chair for shortening the distance between the bottom of the chair and the surface on which it rests whereby the same may be adapted for use on an incline and the chair also includes means for selectively adjusting the front of the chair so that the chair may also be used on an incline by raising or lowering the front portion.

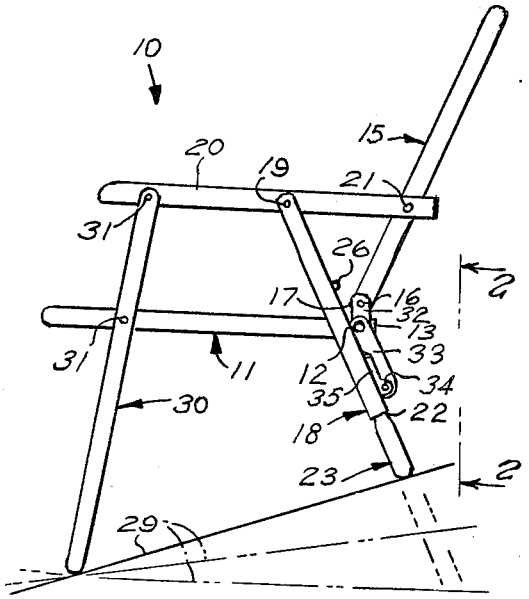

3 Claims, 2 Drawing Sheets